US008863477B2

(12) United States Patent
Stal et al.

(10) Patent No.: US 8,863,477 B2
(45) Date of Patent: Oct. 21, 2014

(54) COLD FORMED STUD AND METHOD OF USE

(71) Applicant: Dizenio Inc., Concord (CA)

(72) Inventors: Irving Stal, Toronto (CA); Hormoz Sayyad, Richmond Hill (CA)

(73) Assignee: Dizenio Inc., Concord, Ontaria ( * ) Notice: Subject to any disclaimer, the term of this patent is extended or adjusted under 35 U.S.C. 154(b) by 0 days.

(21) Appl. No.: 13/774,620

(22) Filed: Feb. 22, 2013

(65) Prior Publication Data

US 2013/0187308 A1 Jul. 25, 2013

Related U.S. Application Data

(63) Continuation-in-part of application No. 12/947,020, filed on Nov. 16, 2010, now abandoned, which is a continuation-in-part of application No. 12/868,806, filed on Aug. 26, 2010, now abandoned.

(51) Int. Cl.

| | |
|---|---|
| ***E04C 3/09*** | (2006.01) |
| ***B21D 47/01*** | (2006.01) |
| ***E04B 1/24*** | (2006.01) |
| *E04C 3/04* | (2006.01) |

(52) U.S. Cl.

CPC ..... *E04B 1/24* (2013.01); *E04C 2003/0421* (2013.01); *E04C 3/09* (2013.01); *E04C 2003/0473* (2013.01); *E04C 2003/0452* (2013.01); *E04C 2003/0417* (2013.01); *E04C 2003/0434* (2013.01); *B21D 47/01* (2013.01)

USPC ..... 52/846; 52/850; 52/851; 52/356; 264/279

(58) Field of Classification Search

CPC ..... E04B 1/24; E04B 1/2403; E04B 1/30; E04C 3/09; E04C 2/384; E04C 2003/0421; E04C 2003/0434; E04C 2003/0473; E04C 2003/0439; B21D 47/01

USPC ..... 52/831, 836, 842, 843, 837, 845, 846, 52/850, 851, 852, 378, 356, 742.14, 435, 52/745.19; 264/279

See application file for complete search history.

(56) References Cited

U.S. PATENT DOCUMENTS

| | | | | | |
|---|---|---|---|---|---|
| D25,413 | S | * | 4/1896 | Jones | D12/43 |
| 2,410,922 | A | * | 11/1946 | Balduf | 52/275 |
| 2,508,032 | A | * | 5/1950 | Kennedy | 52/847 |
| 3,083,794 | A | * | 4/1963 | Stovall, Jr. | 52/364 |
| 3,129,792 | A | * | 4/1964 | Gwynne | 52/364 |
| 3,708,943 | A | * | 1/1973 | Thomas et al. | 52/309.8 |
| 3,753,324 | A | * | 8/1973 | Puccio | 52/377 |
| 4,602,467 | A | * | 7/1986 | Schilger | 52/319 |
| 4,793,113 | A | * | 12/1988 | Bodnar | 52/481.1 |
| 4,909,007 | A | * | 3/1990 | Bodnar | 52/356 |
| 5,157,883 | A | * | 10/1992 | Meyer | 52/357 |
| 5,414,972 | A | * | 5/1995 | Ruiz et al. | 52/600 |
| 5,527,625 | A | * | 6/1996 | Bodnar | 428/595 |

(Continued)

*Primary Examiner* — Brent W Herring

(74) *Attorney, Agent, or Firm* — Miller & Matthias & Hull LLP

(57) ABSTRACT

A cold formed metal stud is provided for commercial and residential construction applications. The metal stud of the present invention is suitable for use in both composite and non-composite applications. The metal stud of the present invention includes an intermediate web, a first flange and a second flange. Each of the intermediate web, first flange and second flange can include a number of different features that can enhance the structural and heat transfer characteristics of the metal stud.

11 Claims, 16 Drawing Sheets

(56) References Cited

U.S. PATENT DOCUMENTS

| | | | | |
|---|---|---|---|---|
| 5,592,796 | A * | 1/1997 | Landers | 52/241 |
| 5,809,724 | A * | 9/1998 | Bodnar | 52/414 |
| 5,927,041 | A * | 7/1999 | Sedlmeier et al. | 52/836 |
| 6,708,459 | B2 * | 3/2004 | Bodnar | 52/356 |
| 6,854,397 | B2 * | 2/2005 | Terajima et al. | 104/95 |
| 7,231,746 | B2 * | 6/2007 | Bodnar | 52/842 |
| D618,365 | S * | 6/2010 | Crane | D25/121 |
| 8,056,303 | B2 * | 11/2011 | Frobosilo | 52/852 |
| 8,341,921 | B2 * | 1/2013 | Bodnar | 52/842 |
| 2003/0014935 | A1 * | 1/2003 | Bodnar | 52/481.1 |
| 2006/0150548 | A1 * | 7/2006 | Bodnar | 52/262 |
| 2007/0175149 | A1 * | 8/2007 | Bodnar | 52/481.1 |
| 2009/0249743 | A1 * | 10/2009 | Bodnar | 52/846 |
| 2010/0037551 | A1 * | 2/2010 | Bodnar | 52/634 |

* cited by examiner

COLD FORMED STUD AND METHOD OF USE

CROSS-REFERENCE TO RELATED APPLICATION

This is a continuation-in-part of co-pending application Ser. No. 12/947,020, filed on Nov. 16, 2010, which is a continuation-in-part of application Ser. No. 12/868,806 filed on Aug. 26, 2010, now abandoned.

FIELD OF THE INVENTION

The present invention relates to cold formed metal studs for composite and non-composite applications in residential and commercial construction projects.

BACKGROUND OF THE INVENTION

Studs are commonly used in the construction industry to provide a support for a wall surface and further support a roof, a floor or the like. Studs can be comprised of a variety of materials including wood and metal. Metal studs are commonly used in a variety of construction styles as they can be manufactured economically and are light, strong and durable.

Metal studs are commonly fashioned from a piece of sheet metal that is cold formed to desired specifications. Cold forming involves working a material below its recrystallization temperature. Generally, cold forming occurs at the ambient temperature of the work environment. The resultant cold formed material is stronger due to manipulations that have been made to the crystal structure of the material. Cold forming is an economical manufacturing process as it does not require the significant energy input required to raise the material above its recrystallization temperature. Cold forming has the further advantage of providing steel structural components that have increased yield capacity in comparison to steel structural components that have not been cold formed.

Pre-fabricated metal studs are well-known in the construction industry. However, there is a distinct lack of metal studs that have been specifically designed for use with both composite and non-composite applications.

Therefore, there is need for a prefabricated metal stud for use in composite and non-composite applications that is light, strong, durable and economically manufactured and can be readily modified depending on the needs of various applications.

SUMMARY OF THE INVENTION

The present invention provides a cold formed stud for use in composite and non-composite applications.

In at least one embodiment, the present invention provides a cold formed metal stud having a vertically extending web, the web having a first longitudinal edge and a second longitudinal edge, a first flange portion vertically extending along the first longitudinal edge, the first flange portion having a vertically extending channel and a second flange portion vertically extending along the second longitudinal edge.

In at least one embodiment, the present invention provides a double stud arrangement wherein two studs are aligned back-to-back in order to provide a stud that is particularly resistant to buckling and twisting.

The present invention also provides a method of forming a composite panel assembly consisting of the steps of pouring a concrete panel and embedding a first flange portion of a cold formed metal stud in the concrete panel, the first flange portion located along a first longitudinal edge of a vertically extending web of the cold formed metal stud such that when the concrete panel solidifies the cold formed metal stud and the concrete panel form a composite panel assembly.

In at least one embodiment, the present invention provides a cold formed stud that can be employed as a ceiling joist. In such applications, the cold formed joist of the present invention can be embedded in a composite ceiling or floor panel.

BRIEF DESCRIPTION OF THE DRAWINGS

Preferred embodiments of the present invention will now be described in greater detail and will be better understood when read in conjunction with the following drawings in which.

DETAILED DESCRIPTION OF THE INVENTION

The cold formed stud of the present invention is contemplated for use in composite and non-composite applications. In composite applications, the cold formed stud can be incorporated directly in a poured concrete wall slab in a manufacturing facility and delivered to the jobsite as a complete assembly for wall erection, among other applications. The composite arrangement provides an integral wall panel and stud assembly that displays excellent strength characteristics, vibration response and load capacity, without unduly stressing the poured concrete wall panel. It is also contemplated that in certain applications, the integral wall panel and stud assembly may be assembled at the jobsite after the cold formed stud has been installed. Composite applications will be discussed in further detail below.

In at least one embodiment, the cold formed stud of the present invention is incorporated in a concrete wall slab as discussed above. However, it is further contemplated that the cold formed stud of present invention can be incorporated in wall slabs formed out of other materials, such as but not limited to fibreglass, polymer resin and other hardenable materials that "set" following an initially liquid state, as will be readily understood by the skilled person.

Figure 26A:
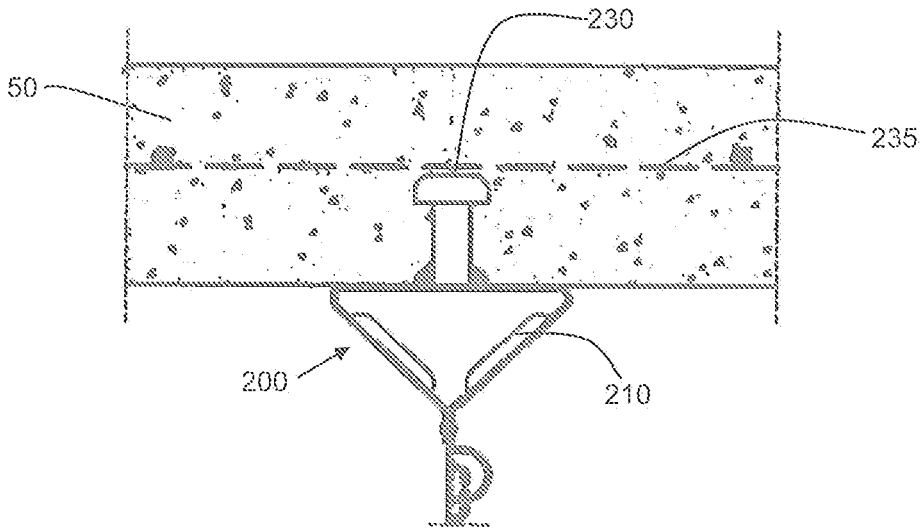
FIG. 26A is a cross-sectional view of a flange and the upper part of the intermediate web employed in a composite application in accordance with an alternative embodiment of the present cold formed metal stud.

It is contemplated that the cold formed stud of the present invention may also be used as a ceiling joist in particular applications that will be readily recognized by the skilled person. Particularly, the cold formed stud of the present application may be employed in applications wherein the ceiling joist is subjected to relatively lightweight loads. In these applications, the cold formed stud may be embedded in a composite roof or floor panel in a manner that is analogous to the process described above relating to composite wall panels. As will be appreciated by the skilled person, the composite wall, roof or floor panel can incorporate wire mesh 235 as seen in FIG. 26A.

FIGS. 1 to 20 illustrate a cold formed stud 10 in accordance with at least one embodiment of the present invention. In these figures, like numerals have been used to denote like elements. Referring initially to FIGS. 1 and 2 and 7 and 8, cold formed stud 10 consists of an intermediate web 20 located between a first flange 30 and a second flange 40. Preferably, cold formed stud 10 is formed from a single piece of sheet metal. However, it is contemplated that intermediate web 20 can be formed from a separate piece of sheet metal than either or both of first flange 30 and second flange 40, and that intermediate web 20 can be attached to either or both of first flange 30 and second flange 40 by methods well known in the art, including but not limited to welding, stitching and fastening with fasteners including but not limited to bolts, rivets, screws and the like. The sheet metal may be formed by any process known in the art such as cold rolling and stamping, among other processes that will be readily apparent to the skilled person.

The size and thickness of the piece of sheet metal used in manufacturing cold formed stud 10 must be sufficient such that the resulting element has the physical properties required for the intended application, the selection of which will be readily apparent to the skilled person in the art. Cold formed stud 10 can be formed of a variety of metals, such as but not limited to steel, stainless steel, galvanized steel and aluminum. Cold formed stud 10 may be formed in various lengths and widths.

Stud 10 can extend upwardly from any foundation or floor structure, among other construction applications that will be readily apparent to the skilled person. Stud 10 can be attached to the foundational structure by any means that is suitable. Further, the stud can support a roof truss, floor joist or any other structure that will also be apparent to the skilled person. It can also support an exterior wall panel, interior wall panel, window frame, door frame or any other wall arrangement known in the construction industry.

In at least one embodiment, intermediate web 20 includes a number of web openings 22 located along the centre line of the intermediate web 20. Web openings 22 can take a variety of shapes including triangular, square, oval, circular and other shapes that will be readily contemplated by the skilled person. It is important to note however that web openings 22 will provide further stiffness to intermediate web 20 and be less prone to fatigue failure if the corners of web openings 22 are formed with rounded corners rather than sharp corners, as can be seen in FIGS. 5, 11, 15 to 18 and 23.

In at least one embodiment, web openings 22 can further include a stiffening rim 24 that extends around the perimeter of web openings 22. Stiffening rim 24 is formed of material displaced from intermediate web 20 when web openings 22 are formed. Stiffening rim 24 can be formed with a semi-circular, arcuate, ovular, or square cross sectional profile among other cross-sectional profiles that will be readily apparent to the skilled person. Stiffening rim 24 may extend discontinuously around the perimeter of web opening 22, however stiffening rim 24 will provide improved stiffness to intermediate web 20 and be less prone to fatigue failure if stiffening rim 24 extends continuously around the perimeter of web openings 22, as can be seen in FIGS. 1, 2, 7, 8, 15 to 18 and 23.

In at least one embodiment, intermediate web 20 can further include a series of longitudinally extending stiffening ribs 26, as can be seen in FIGS. 7, 8, 11, 17, 18, 21 and 22. Longitudinally extending stiffening ribs 26 can extend along the intermediate web 22 in any pattern that will depend upon the arrangement of other features of the present invention. In at least one embodiment and as can be seen in FIGS. 7, 8, 11, 17 and 18, longitudinally extending ribs 26 extend in a zig-zag pattern along the upper and lower edges of intermediate web 20 such that longitudinally extending ribs 26 extend parallel in the areas between web openings 22 and the edges of intermediate web 20 and extend angularly toward the centerline of the intermediate web 20 in areas where there is no web opening. Additional stiffening ribs 26 can also be located in the ends of cold formed stud 10 as can be seen in FIGS. 7, 8, 11, 16 and 18.

In at least one embodiment, intermediate web 20 can further include a series of stiffening indentations 28 that can be located in any part of intermediate web 20 that can require additional stiffening, as can be seen in FIGS. 2, 5, 7, 8, 16, 18, 22 and 25. In at least one embodiment, stiffening indentations 28 are located in the area between the angled portions of longitudinally extending stiffening ribs 26. Stiffening indentations 28 can be formed in any shape, including circular, square, rectangular or any other shape that will be readily apparent to the skilled person. As discussed above, stiffening indentations 28 can be formed with rounded edges to provide further resistance to fatigue failure.

Figure 18:
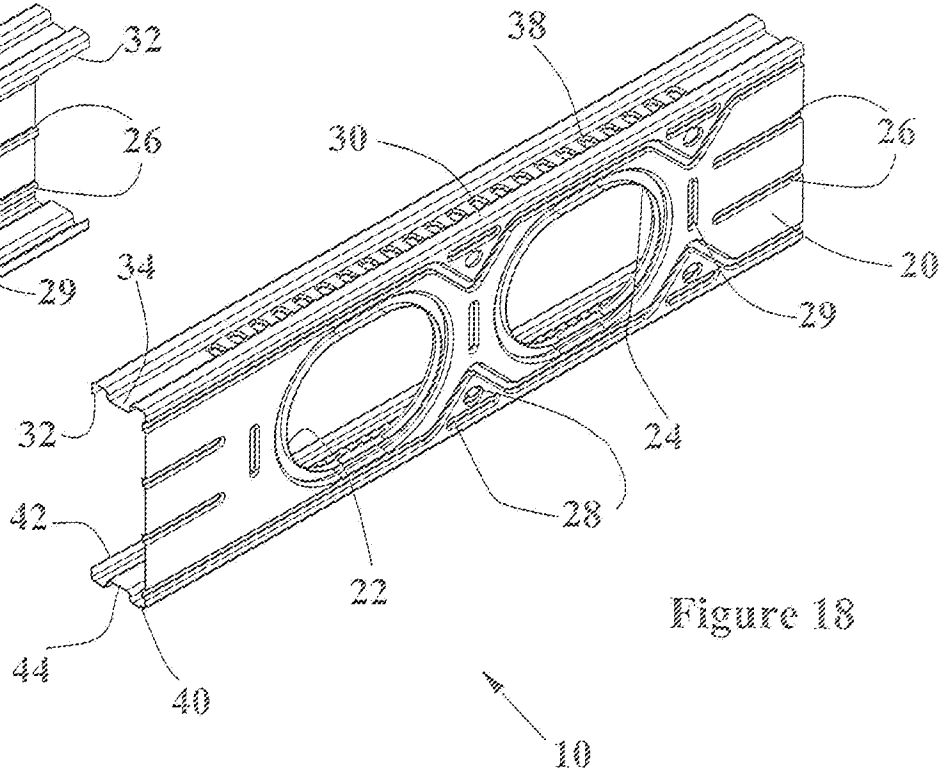
FIG. 18 is a front perspective view of the cold formed metal stud of FIG. 17.
Figure 17:
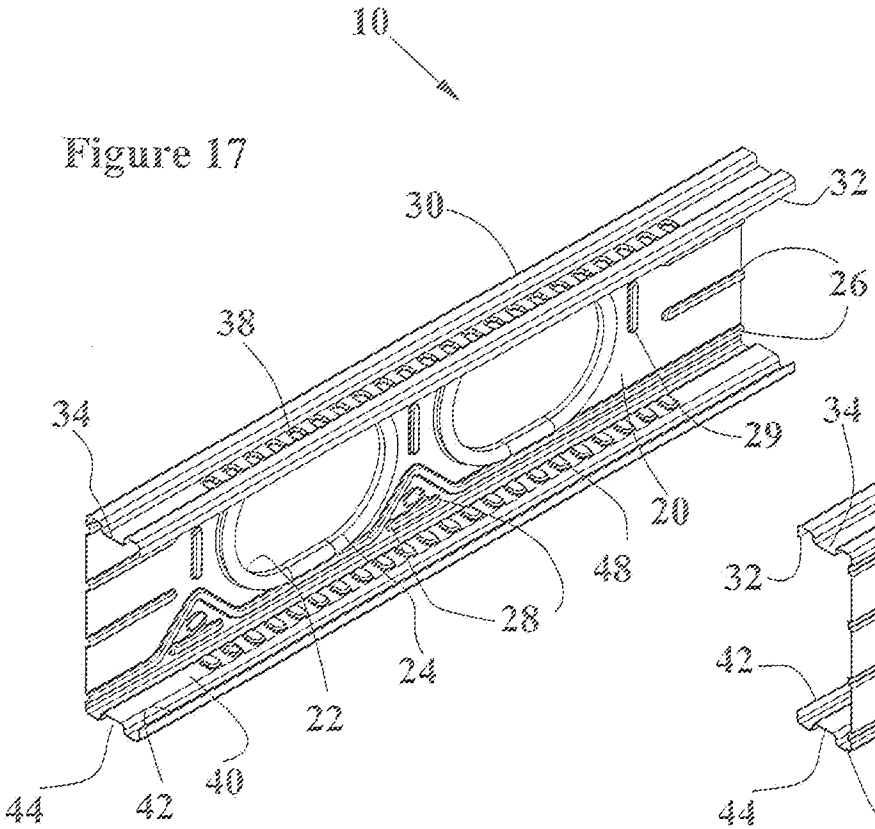
FIG. 17 is a rear perspective view of a cold formed metal stud in accordance with another embodiment of the present invention.
Figure 23:
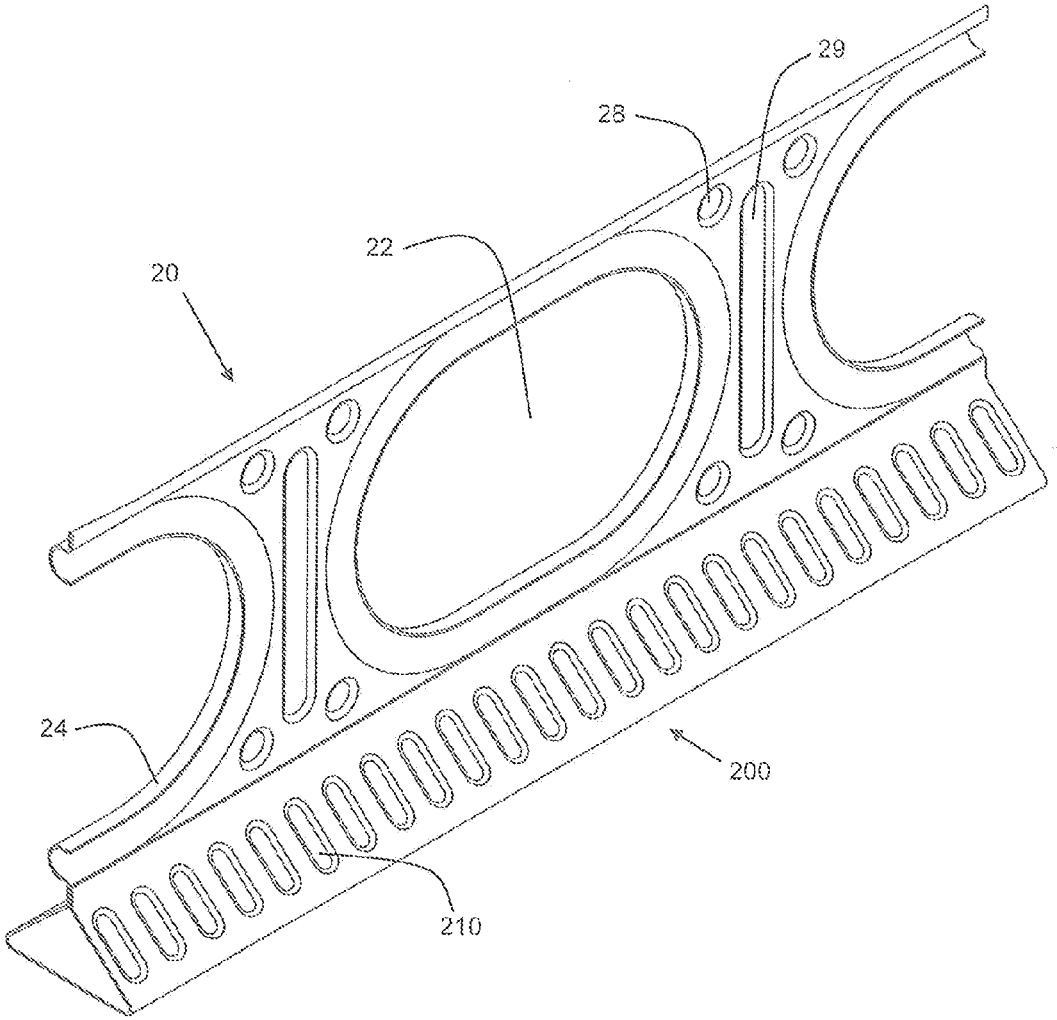
FIG. 23 is a side perspective view of the web and one flange of another embodiment of the present cold formed metal stud having an alternate web layout.
Figure 24A:
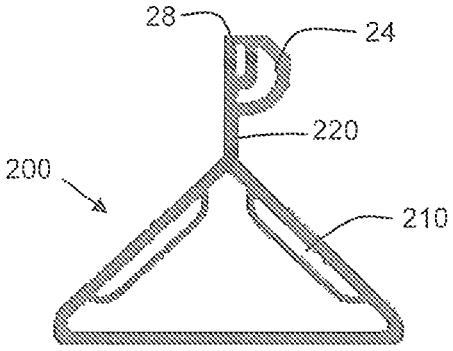
FIG. 24A is a cross-sectional view of the flange and the lower part of the intermediate web of the embodiment of FIG. 23.
Figure 24B:
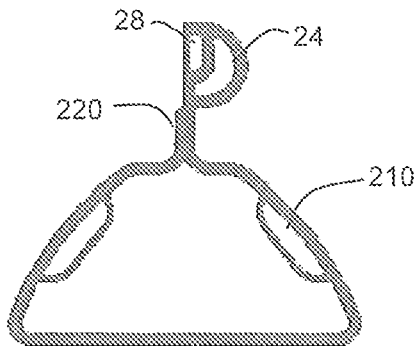
FIG. 24B is a cross-sectional view of a flange and the lower part of the intermediate web in accordance with an alternative embodiment of the present cold formed metal stud.
Figure 24C:
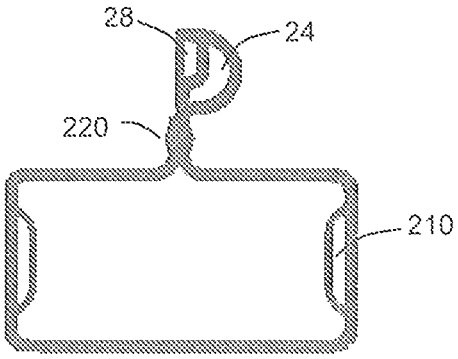
FIG. 24C is a cross-sectional view of a flange and the lower part of the intermediate web in accordance with an alternative embodiment of the present cold formed metal stud.
Figure 24D:
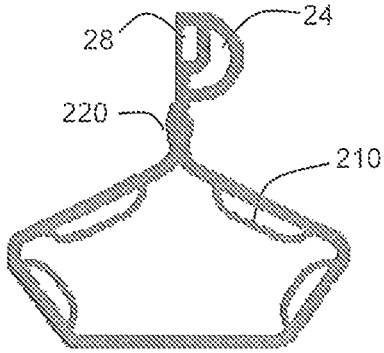
FIG. 24D a cross-sectional view of a flange and the lower part of the intermediate web in accordance with an alternative embodiment of the present cold formed metal stud.

In at least one embodiment, intermediate web 20 can further include a series of transverse stiffening ribs 29 that can be located in any part of intermediate web 20 that can require additional stiffening, as can be seen in FIGS. 17, 18 and 23. In at least one embodiment, transverse stiffening ribs 29 are located between adjacent web openings 22. Stiffening ribs 29 are analogous to stiffening indentations 28 in that they can be formed in any shape, including circular, square, rectangular or any other shape that will be readily apparent to the skilled person. As discussed above, stiffening ribs 29 can be formed with rounded edges to provide further resistance to fatigue failure.

Stiffening elements, including but not limited to web openings 22, stiffening rim 24, longitudinally extending stiffening ribs 26, stiffening indentations 28 and transverse stiffening ribs 29, can be formed by any suitable manufacturing processes including stamping, milling and rolling, among other manufacturing processes that will be readily apparent to the skilled person. In addition to providing stiffness to stud 10, these additional features also serve to reduce the heat transfer characteristics of stud 10. By this it is meant that these features reduce the rate at which the stud conducts heat for improved heating or cooling of a space at least partially enclosed by structures that incorporate studs 10.

As discussed above, first flange 30 is formed along one longitudinal edge of intermediate web 20, as seen in FIGS. 1, 2, 7, 8, 16, 18, 21 and 22. In at least one embodiment, first flange 30 is oriented perpendicularly to intermediate web 20, however it is contemplated that first flange 30 can be oriented at any angle in relation to intermediate web 20 depending on the needs of the application.

Figure 21:
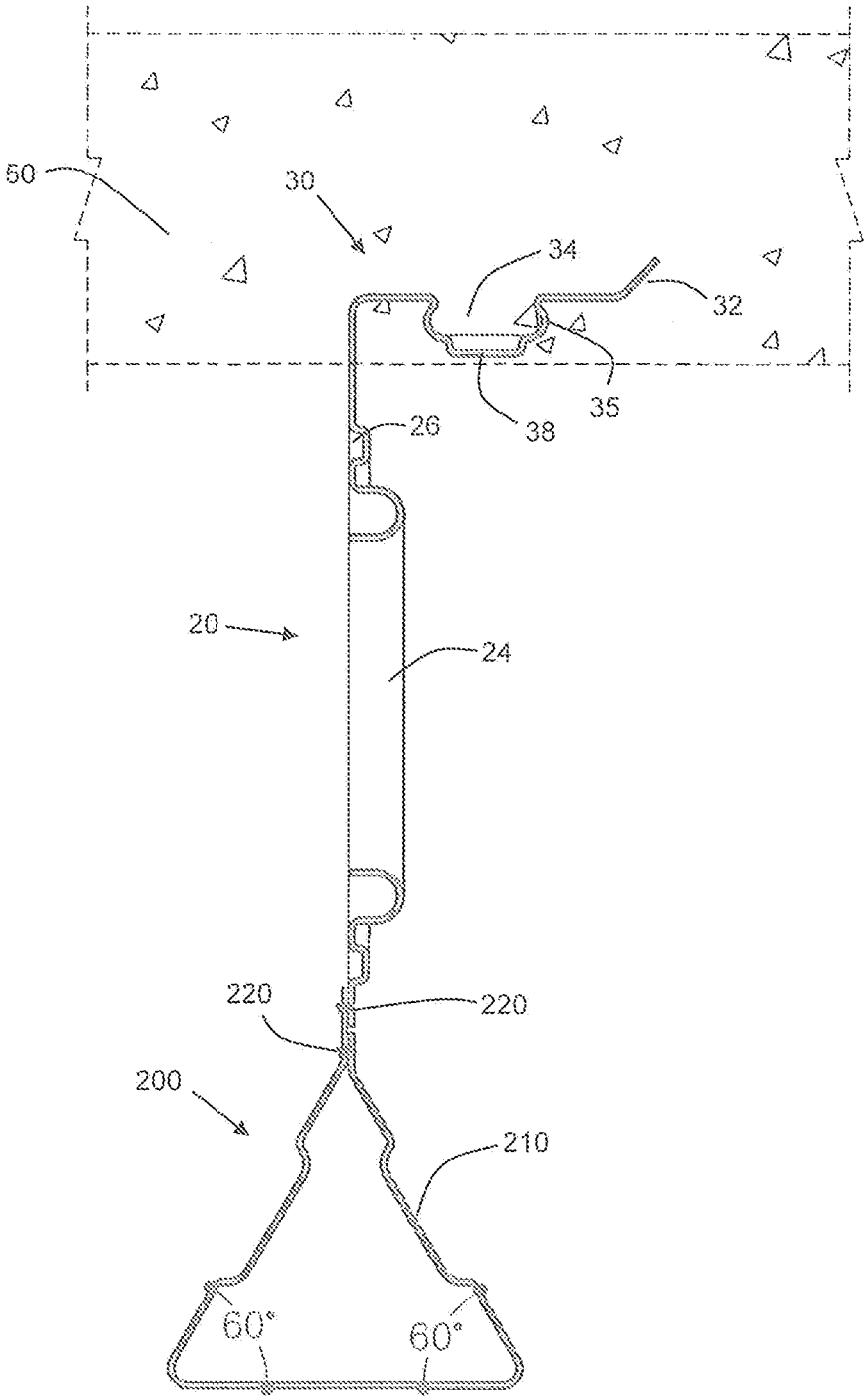
FIG. 21 is a cross-sectional view of an alternative embodiment of the present cold formed metal stud.
Figure 22:
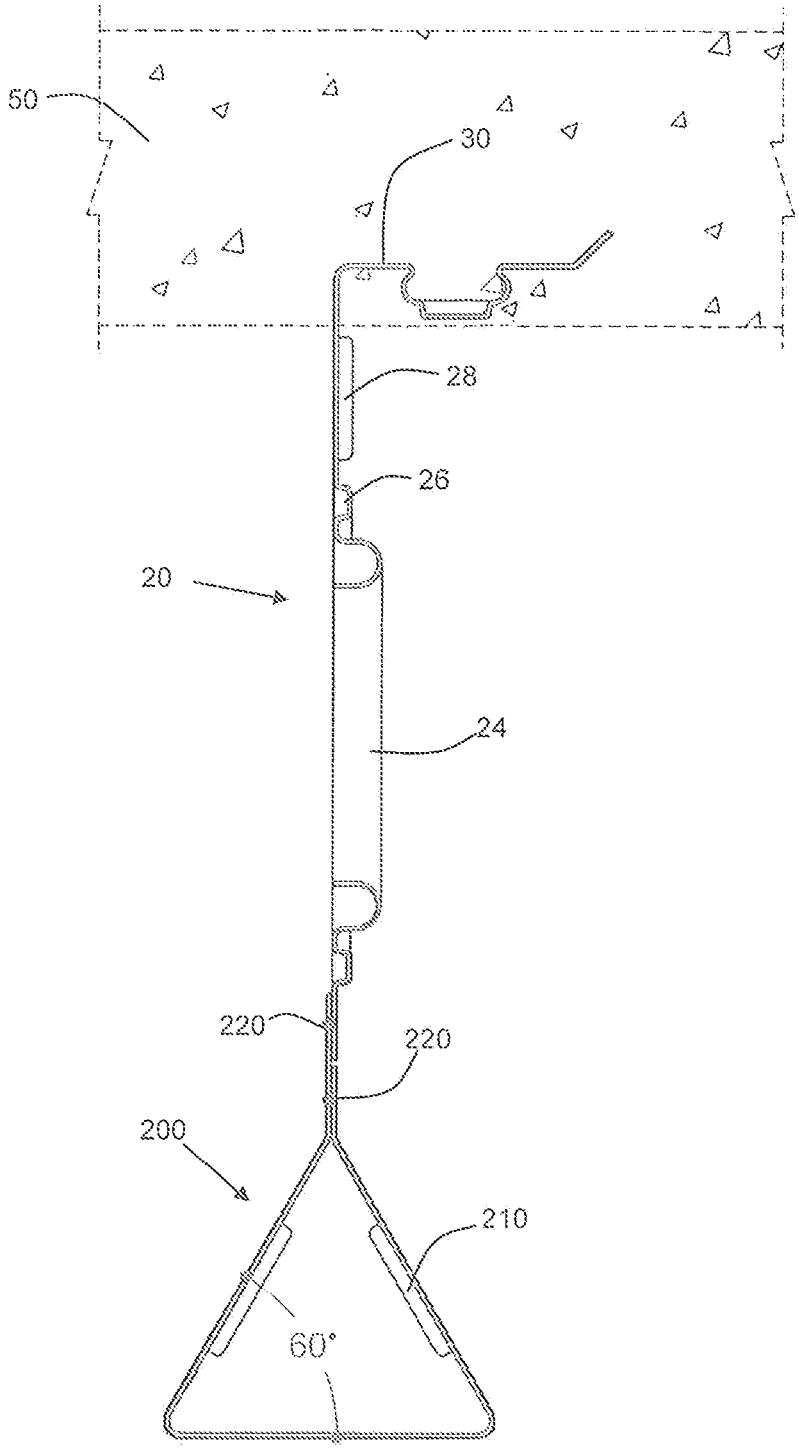
FIG. 22 is a cross-sectional view of an alternative embodiment of the present cold formed metal stud.

With reference to FIGS. 1, 2, 7, 8, 13, 15 to 18, 21 and 22, first flange 30 can include an end flange 32. End flange 32 can be oriented perpendicularly to first flange 30 however it is contemplated that end flange 32 can be oriented at any angle in relation to first flange 30 as required by the application. In at least one embodiment, end flange 32 is oriented at an obtuse angle to first flange 30, as seen in FIGS. 21 and 22.

As can be seen in FIGS. 1 to 4, 6, 7 to 10, 12 and 15 to 18, first flange 30 can include a longitudinally extending channel 34 that is located along the centre line of first flange 30. As can be seen in FIGS. 3, 6, 9 and 12, it is contemplated that channel 34 has channel walls that are orthogonal to the channel floor when viewed in cross section, however channel 34 can take any cross-sectional shape as required by the application, such as triangularly shaped, U-shaped or dovetail shaped as will be appreciated by the skilled person. As seen in FIGS. 21 and 22, in at least one embodiment, the walls of channel 34 can be shaped to include bulges 35. Longitudinally extending channel 34 provides stiffness to first flange 30 and also provides a cavity wherein a hardenable fluid, including but not limited to concrete, polymer resin or fibreglass can be poured thereinto such that first flange 30 can be securely embedded in a concrete panel when cold formed stud 10 is employed in composite applications, as will be discussed in further detail below.

First flange 30, end flange 32 and channel 34 can be formed by any suitable manufacturing process that will be readily apparent to the skilled person. Further, first flange 30, end flange 32 and channel 34 can be formed with any type of bend that suits the application, however radial bends provide a cold formed stud that has the requisite stiffness and fatigue resistance.

Figures 9, 10, 11, 12:
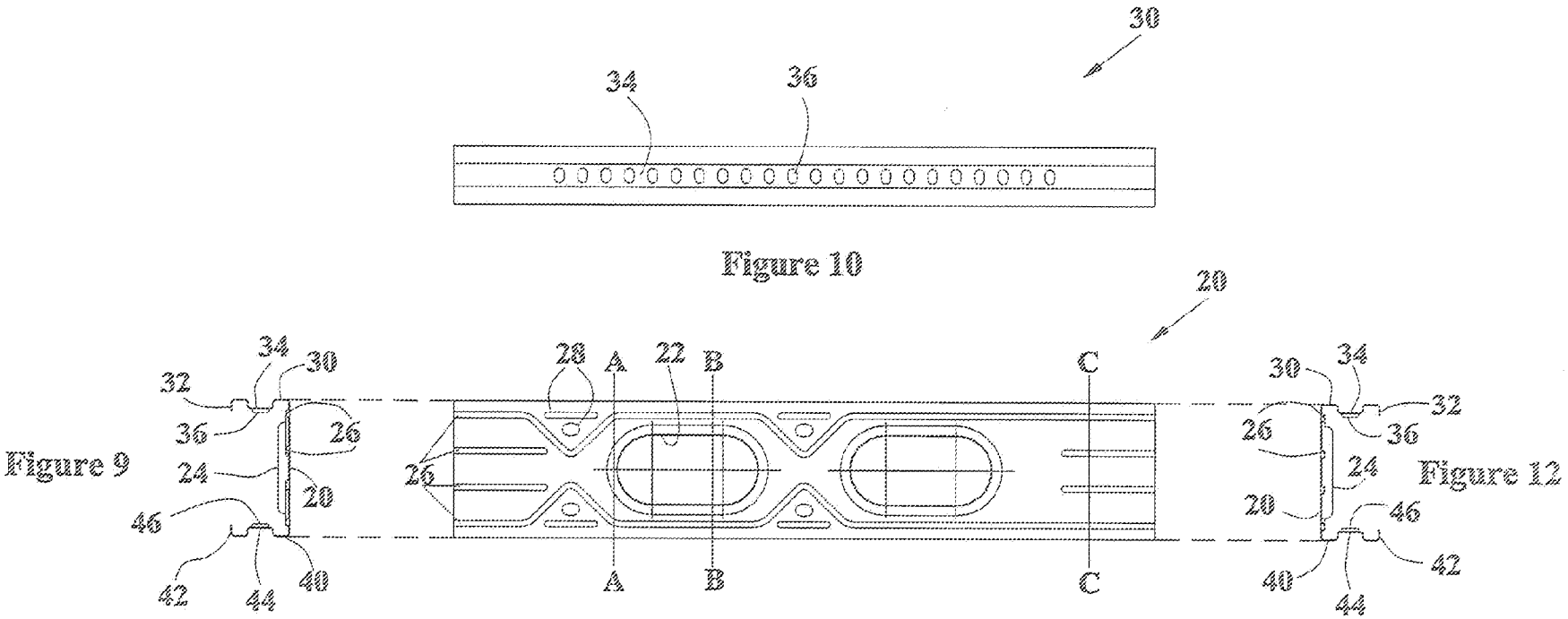
FIG. 9 is an end elevational view of the cold formed metal stud of FIG. 7.
FIG. 10 is a top plan view of the cold formed metal stud of FIG. 7.
FIG. 11 is a front side elevational view of the cold formed metal stud of FIG. 7.
FIG. 12 is an opposite end elevational view of the cold formed metal stud of FIG. 7.

In at least one embodiment and as can be seen in FIG. 10 for example, channel 34 can include a series of perforations 36 located on the channel floor. Perforations 36 can extend along the entire length of channel 34 or alternatively can be located on only a section of channel 34. In at least one embodiment perforations 36 are ovoid or elliptically shaped, however it is contemplated that perforations 36 can take any shape that suits the intended application. Perforations 36 serve a number of purposes including providing a thermal break which facilitates heat dissipation from cold formed stud 10. Further, in composite applications, perforations 36 allow first flange 30 to be integrally embedded in concrete by allowing liquid concrete, polymer resin or fibreglass to fill the entire volume of channel 34 without creating any air bubbles within channel 34.

In at least one embodiment and as can be seen in FIGS. 4, 16, 18, 21 and 22, channel 34 can include a series of indentations 38 located on the channel floor. Indentations 38 can extend along the entire length of channel 34 or alternatively can be located on only a section of channel 34. In at least one embodiment indentations 38 are ovoid or elliptically shaped, however it is contemplated that indentations 38 can take any shape that suits the intended application. In composite applications, indentations 38 can accept a hardenable fluid such as concrete, helping to tie cold formed stud 10 to the concrete and to prevent delamination and separation of the concrete from the flange 30.

As can be seen in FIGS. 1, 2, 7, 8, 15 and 17, second flange 40 is analogous to first flange 30 and can incorporate some or all the features recited above in relation to first flange 30. In this way, second flange 40 may include an end flange 42, a channel 44, perforations 46 and/or indentations 48 depending on the needs of the application.

Figure 14:
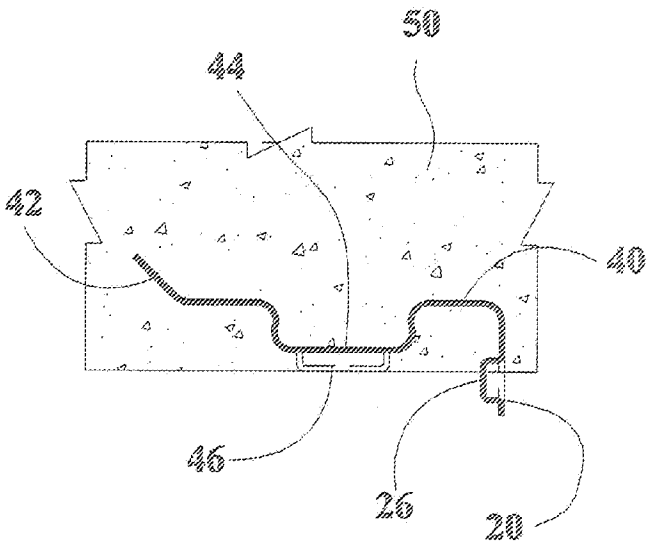
FIG. 14 is a partial end view of the cold formed metal stud of FIG. 13 embedded in the concrete panel.
Figure 13:
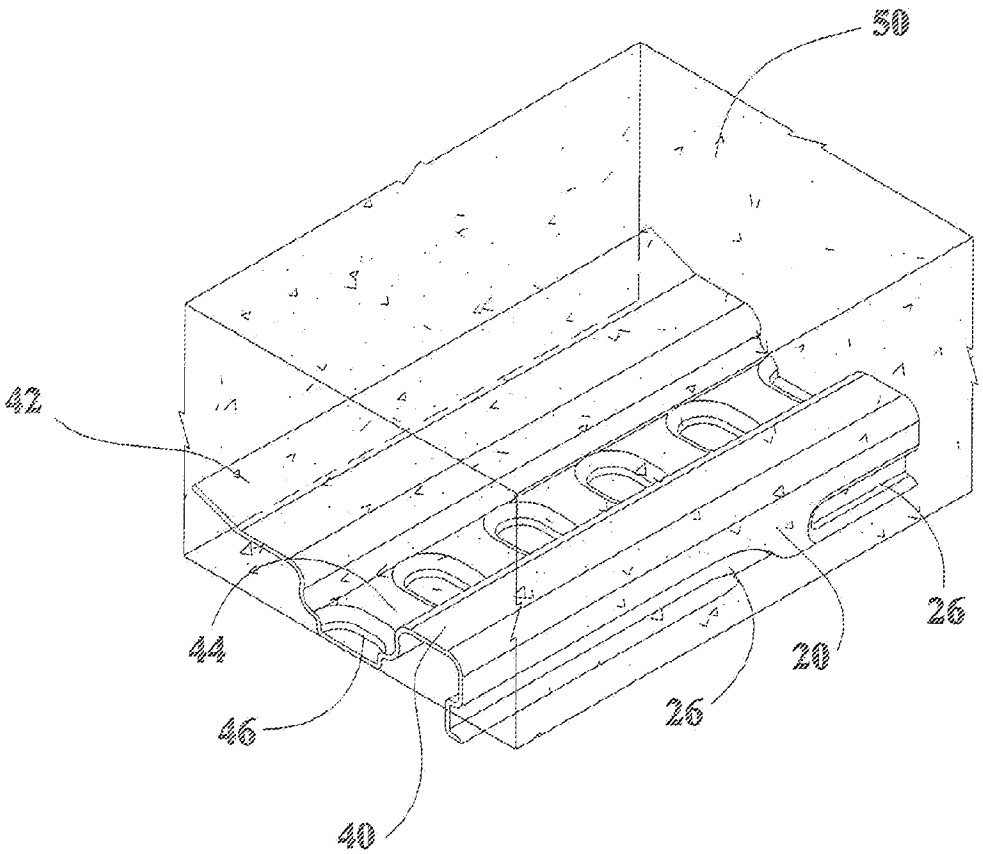
FIG. 13 is a partial perspective sectional view of the cold formed metal stud of FIG. 7 with modifications embedded in a concrete panel.
Figures 15, 16:
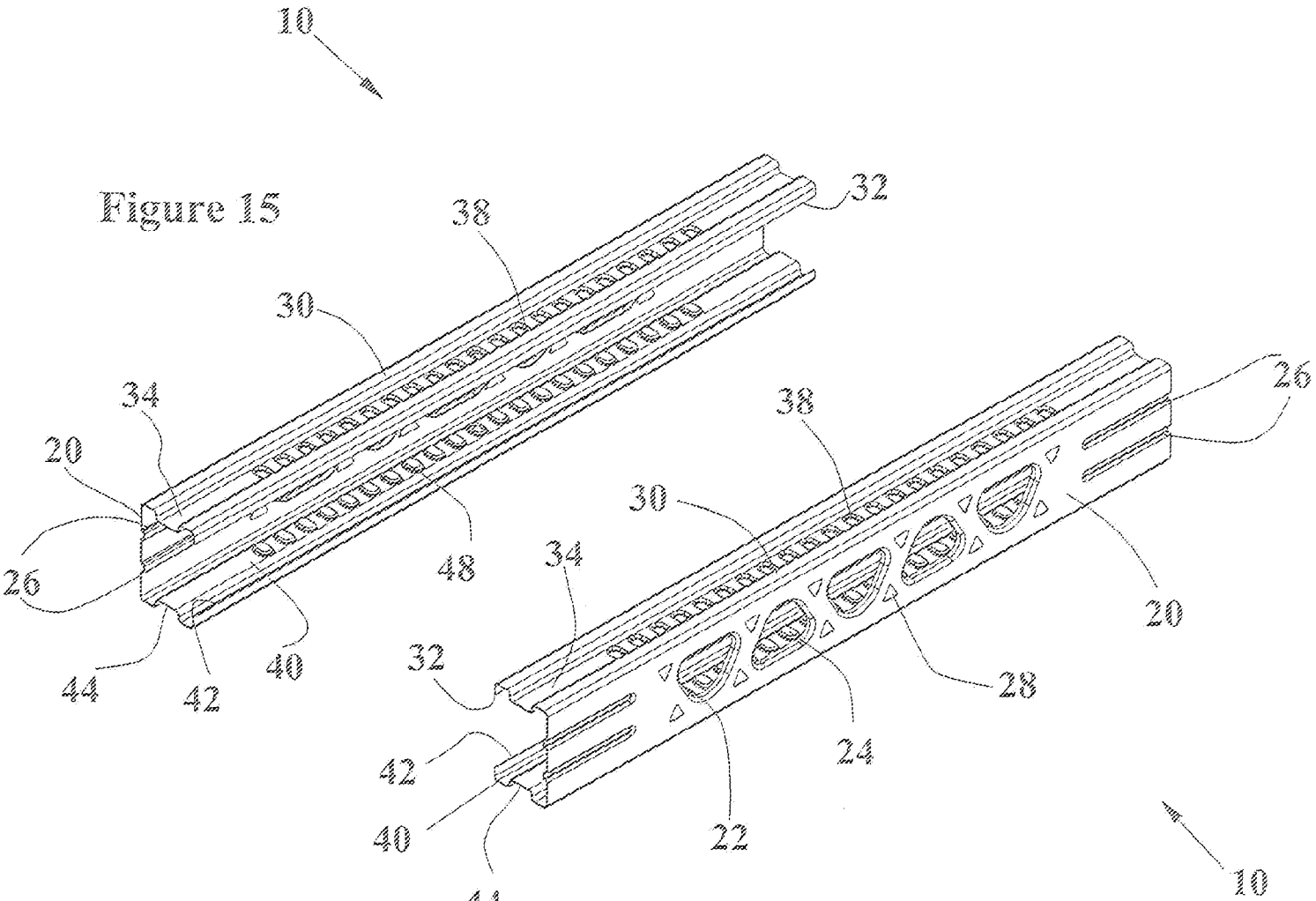
FIG. 15 is a rear perspective view of a cold formed metal stud in accordance with another embodiment of the present invention.
FIG. 16 is a front perspective view of the cold formed metal stud of FIG. 15.

As can be seen in FIGS. 13 and 14, the present invention may be utilized in composite applications to produce a composite stud/panel assembly wherein the stud component is lighter and stiffer in comparison to similar non-composite stud arrangements. As will be appreciated, in these views, only one of the stud's flanges 30 or 40 is shown as is only a small portion of web 20. The remainder of the stud 10 is not shown for clarity. As discussed above, either one or both of first flange 30 or second flange 40 can be adapted with any of the optional features identified above such that either flange can be securely embedded in a concrete panel 50. These features include end flange 32, channel 34, bulges 35, perforations 36 and/or indentations 38, all of which can be adapted or modified depending on the needs of the particular composite application.

For example and as can be seen in FIGS. 13 and 14, cold formed stud 10 can designed with a second flange 40 having an end flange 42 that is oriented at an obtuse angle to second flange 40. Further, second flange 40 can be designed with a channel 44 that has a slightly dove-tail shaped profile, including bulges, for an improved "lock" with the concrete to prevent lateral separation. Channel 44 can also have a series of perforations 46 located along the floor of channel 44. Perforations 46 can take any shape and can be formed by any suitable manufacturing process. Perforations 46 can be as numerous as required by the application. As also discussed above, intermediate web 20 can have stiffening rib 26 which can also be partially embedded in concrete panel 50. In this way, cold formed stud 10 is securely embedded in concrete panel 50 as concrete flows through perforations 46 and completely fills channel 44 without trapping any air bubbles, resulting in a composite stud/panel assembly that has improved structural characteristics over existing composite designs.

In at least one embodiment, cold formed stud 10 (which can include the optional features recited above such as web openings 22, stiffening rim 24, longitudinally extending stiffening ribs 26, stiffening indentations 28, transverse stiffening ribs 29, end flange 32, channel 34, perforations 36 and/or indentations 38) can be specifically designed such that the cross sectional area is constant at all locations along cold formed stud 10.

Figure 1:
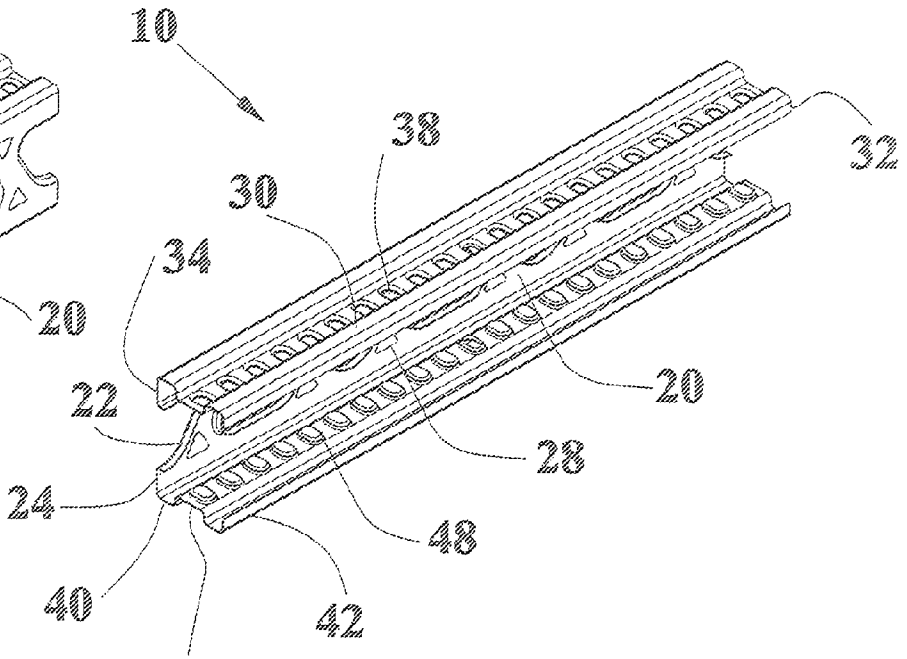
FIG. 1 is a rear perspective view of a cold formed metal stud in accordance with at least one embodiment of the present invention.
Figure 2:
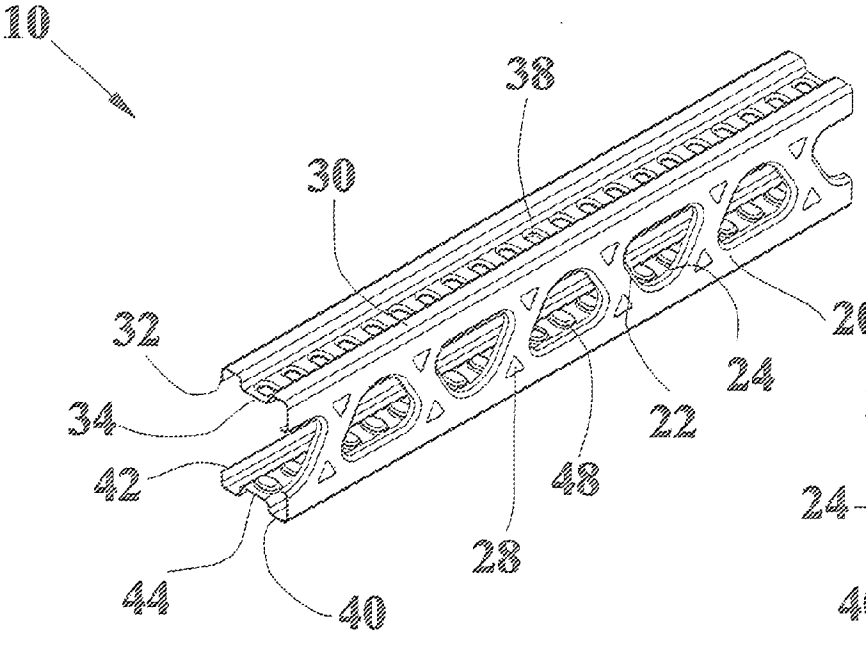
FIG. 2 is a front perspective view of the cold formed metal stud of FIG. 1.
Figure 4:
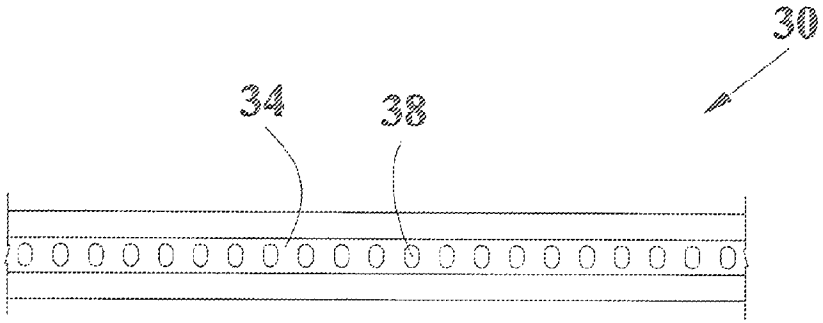
FIG. 4 is a top plan view of the cold formed metal stud of FIG. 1.
Figure 5:
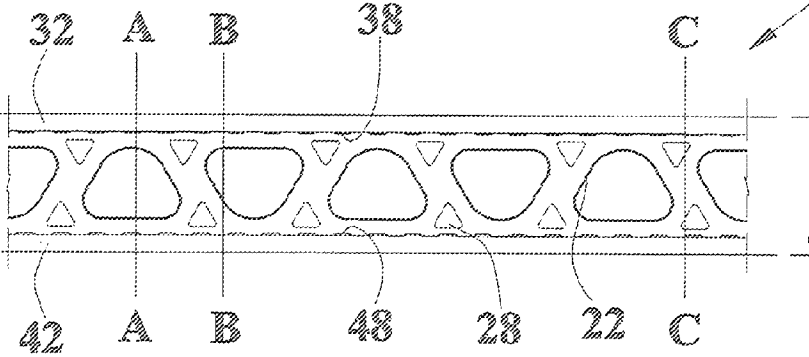
FIG. 5 is a rear side elevational view of the cold formed metal stud of FIG. 1.
Figure 6:
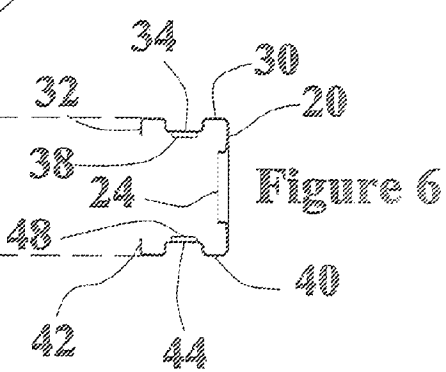
FIG. 6 is an opposite end elevational view of the cold formed metal stud of FIG. 1.
Figure 3:
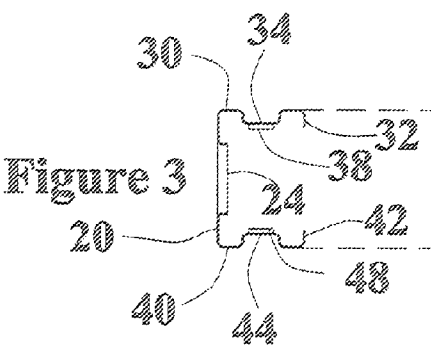
FIG. 3 is an end elevational view of the cold formed metal stud of FIG. 1.
Figure 7:
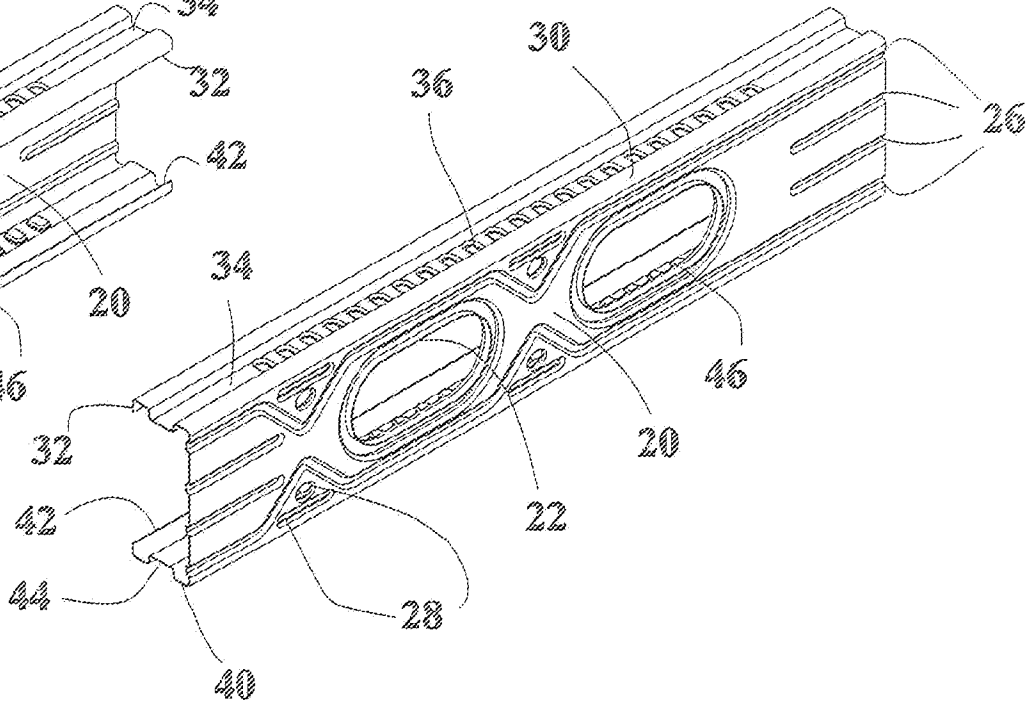
FIG. 7 is a front perspective view of a cold formed metal stud in accordance with another embodiment of the present invention.
Figure 8:
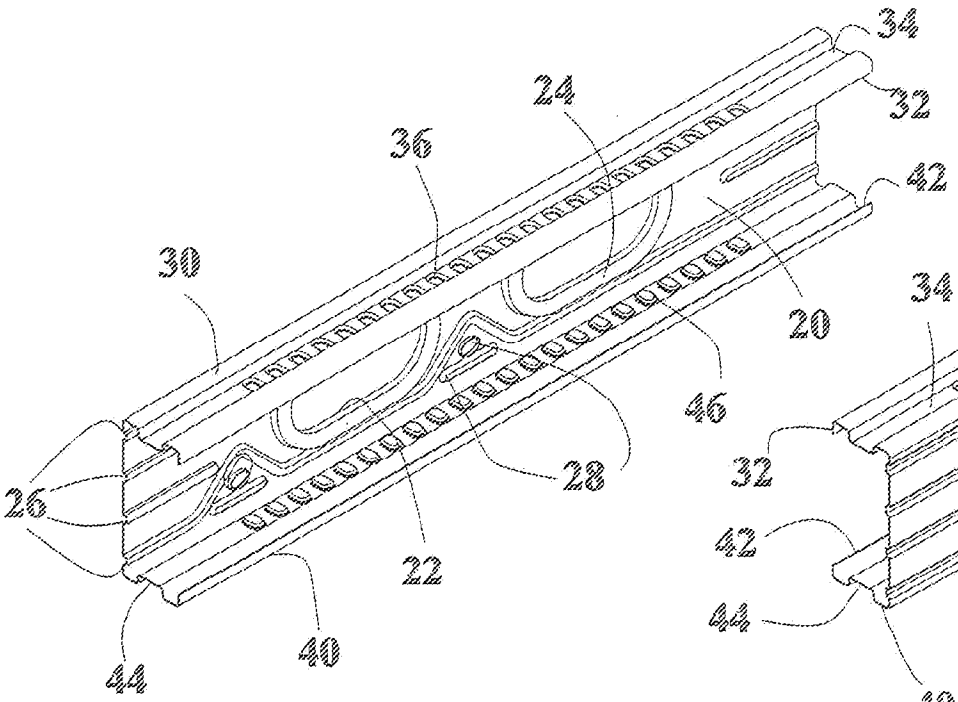
FIG. 8 is a rear perspective view of the cold formed metal stud of FIG. 7.

With reference to FIGS. 5 and 11, cold formed stud 10 can be designed such that the cross sectional area of the stud at section A-A, B-B and C-C is approximately equivalent. In embodiments where the cross-sectional area of cold formed stud 10 is constant at any point along the length of the stud, it will be understood that related structural properties, such as the moment of inertia and the section modulus of the stud will also be constant at any point along the length of the stud. This results in a structural element that is stronger, stiffer and more resistant to compressive and torsional forces, as will be readily understood by the skilled person in the art.

Figure 19:
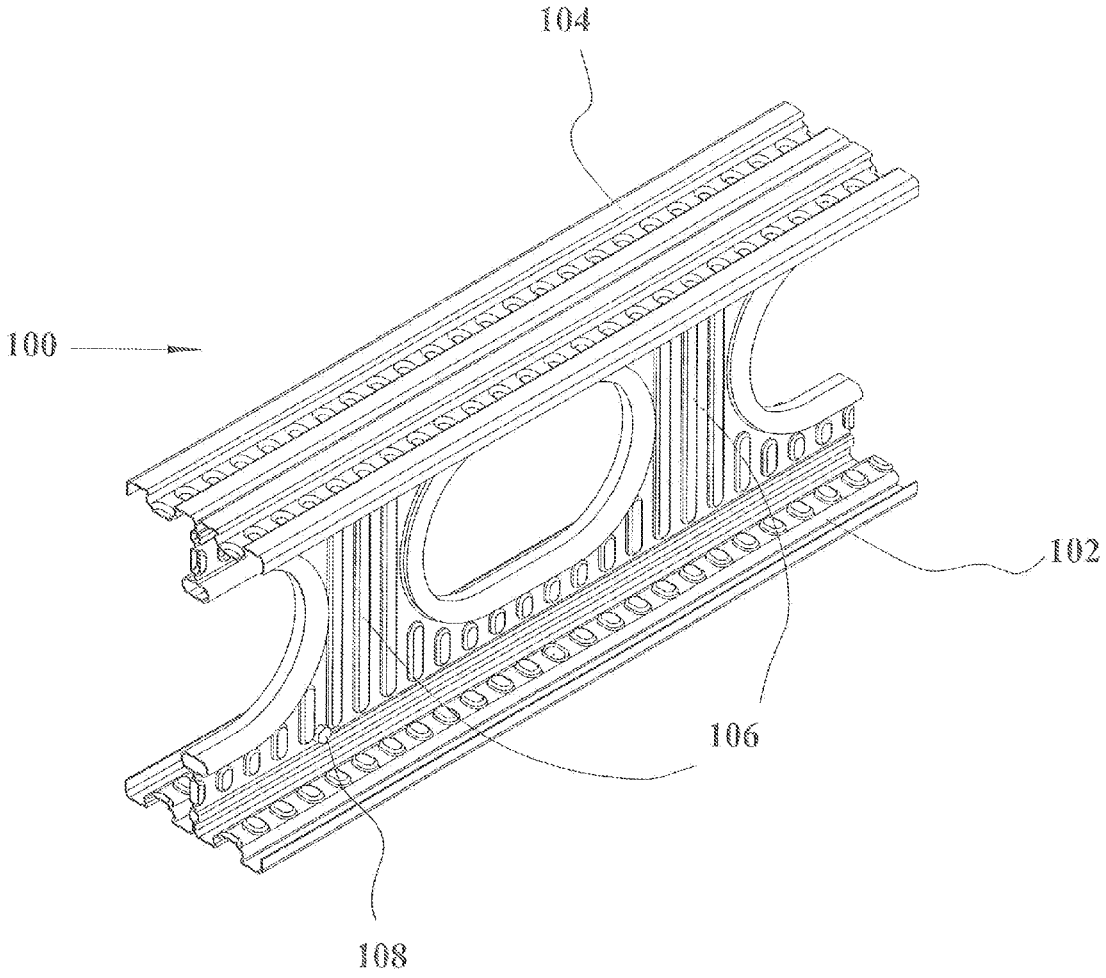
FIG. 19 is a front perspective view of a double stud arrangement in accordance with another embodiment of the present invention.
Figure 20:
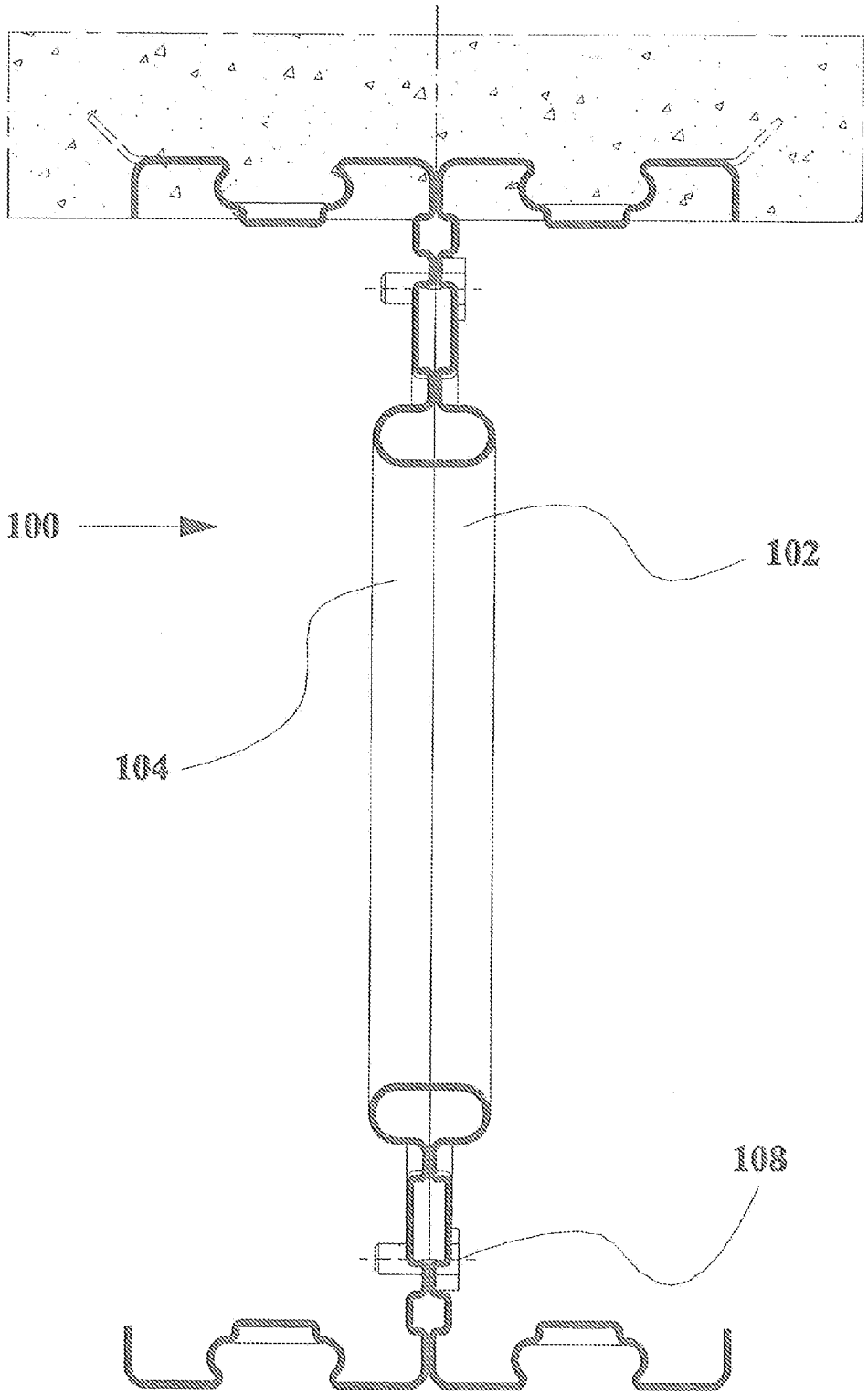
FIG. 20 is a cross-sectional view of the double stud of FIG. 19 embedded in a concrete panel.

With reference to FIGS. 19 and 20, in at least one embodiment a double stud arrangement is contemplated that is well suited to applications where the stud is subjected to particularly high loads. Double stud 100 includes a first cold formed stud 102 and a second cold formed stud 104 that are analogous to cold formed stud 10 and can include any of the features identified above with respect to a single cold formed stud. First cold formed stud 102 and second cold formed stud 104 are arranged such that the intermediate webs of each stud abut one another. In at least one embodiment, the two cold formed studs are symmetrical and aligned such that the web openings on first cold formed stud 102 align with the web openings of second cold formed stud 104, as seen in FIG. 19.

In at least one embodiment and as can be seen in FIG. 19, it is contemplated that each of first cold formed stud 102 and second cold formed stud 104 can have a plurality of vertical stiffening ribs 106. Stiffening ribs 106 are analogous to longitudinally extending stiffening ribs 26 with the exception that stiffening ribs are orthogonally oriented in relation to the longitudinal axis of the stud to provide torsional stiffness to the resultant double stud 100.

In at least one embodiment the two studs are connected by way of a bolt 108, however other fasteners are also contemplated such as welds, rivets, stitching and sheet metal screws among other fasteners that will be readily apparent to the skilled person.

It is contemplated that double stud 100 may also be used as a ceiling joist in particular applications that will be readily recognized by the skilled person. In these applications, double stud 100 may be embedded in a composite roof or floor panel in a manner that is analogous to the process described above relating to composite wall panels.

In at least one alternative embodiment of the present cold formed stud, as shown in FIGS. 21 to 26B, either or both of first flange 30 and second flange 40 can be a closed section flange 200 having a hollow interior. Closed section flange 200 can be formed by rolling sheet metal into the desired profile. Closed section flange 200 can be connected to intermediate web 10 by connection element 220, which in at least one embodiment is a spot-weld, a stitch, or a rivet.

Figure 25:
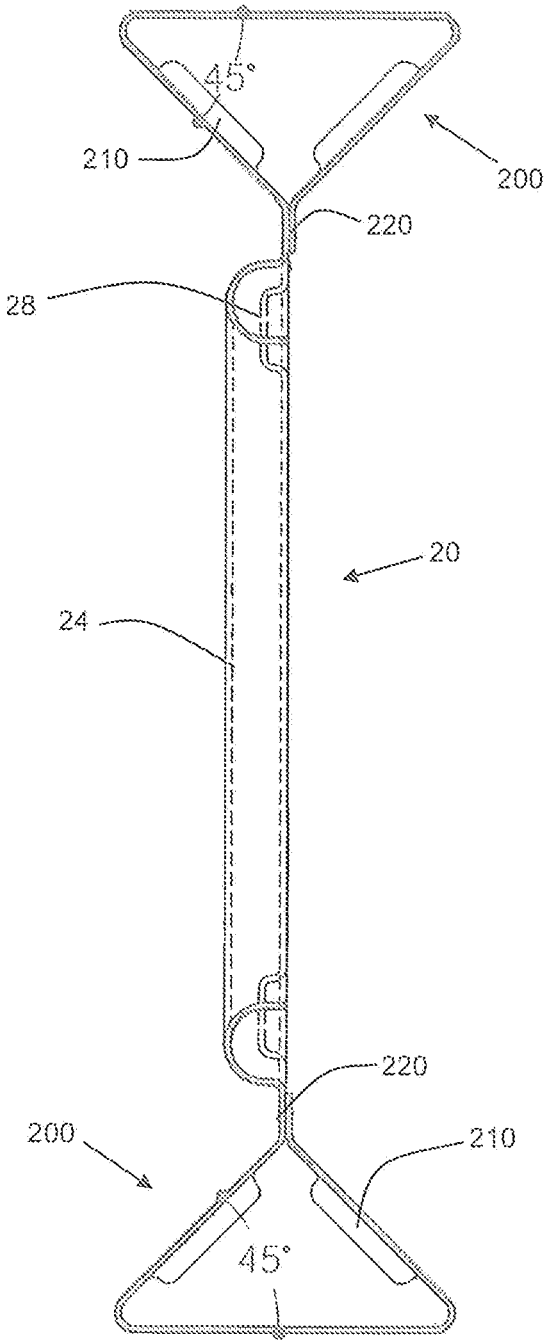
FIG. 25 is a cross-sectional view of an alternative embodiment of the present cold formed metal stud.

In at least one embodiment, closed section flange 200 can be substantially triangular in cross section, however other cross-section profiles are contemplated, as seen, for example, in FIGS. 24A-D. When closed section flange 200 is triangular, in at least one embodiment, it advantageously takes the form of an equilateral triangle, with angles of 60°, as seen in FIGS. 21 and 22. Such a flange has an efficient geometric shape for applications where a tension flange is required. In at least one alternative embodiment, for applications where a compression flange is required, a triangular closed section flange advantageously is in the form of an isosceles right triangle, with angles of 45° at the vertices which are not connected to the intermediate web, as seen in FIG. 25.

In at least one embodiment, closed section flange 200 can be embossed by one or more indentations 210 (FIGS. 21 to 26B), which serve to increase the steel yield strength and prevent local buckling of the flange when the flange is subjected to a high concentrated load. The indentations 210 can be in the form of dimples spaced along the flange, in the form of a longitudinal rib, or in any other form known to the skilled person. The spacing of indentations 210 can be about 1 inch on center, or any other spacing recognized by the person of skill in the art. The use of such very stiff closed section flanges can impart desirable properties to the present cold formed stud, including but not limited to large resistance to rotation or twist and resistance to vibration.

Figure 26B:
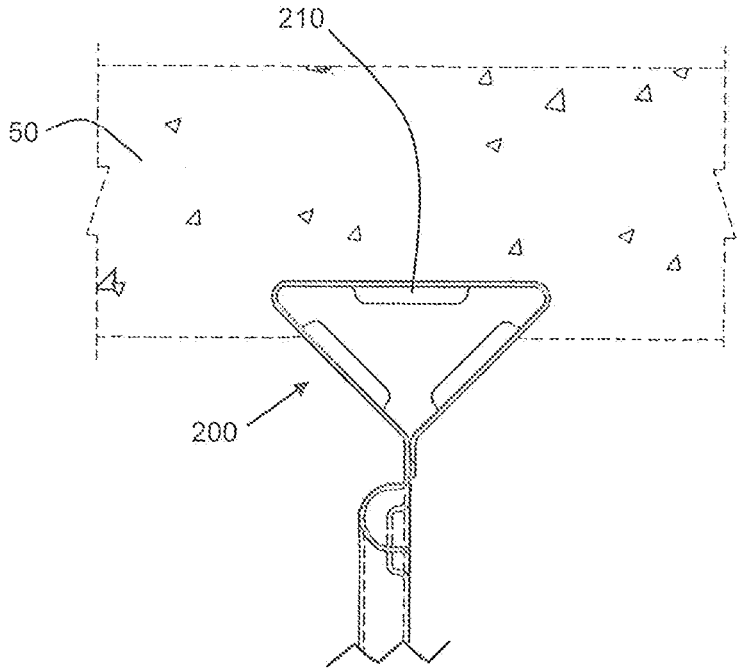
FIG. 26B is a cross-sectional view of a flange and the upper part of the intermediate web employed in a composite application in accordance with an alternative embodiment of the present cold formed metal stud.
Figure 27:
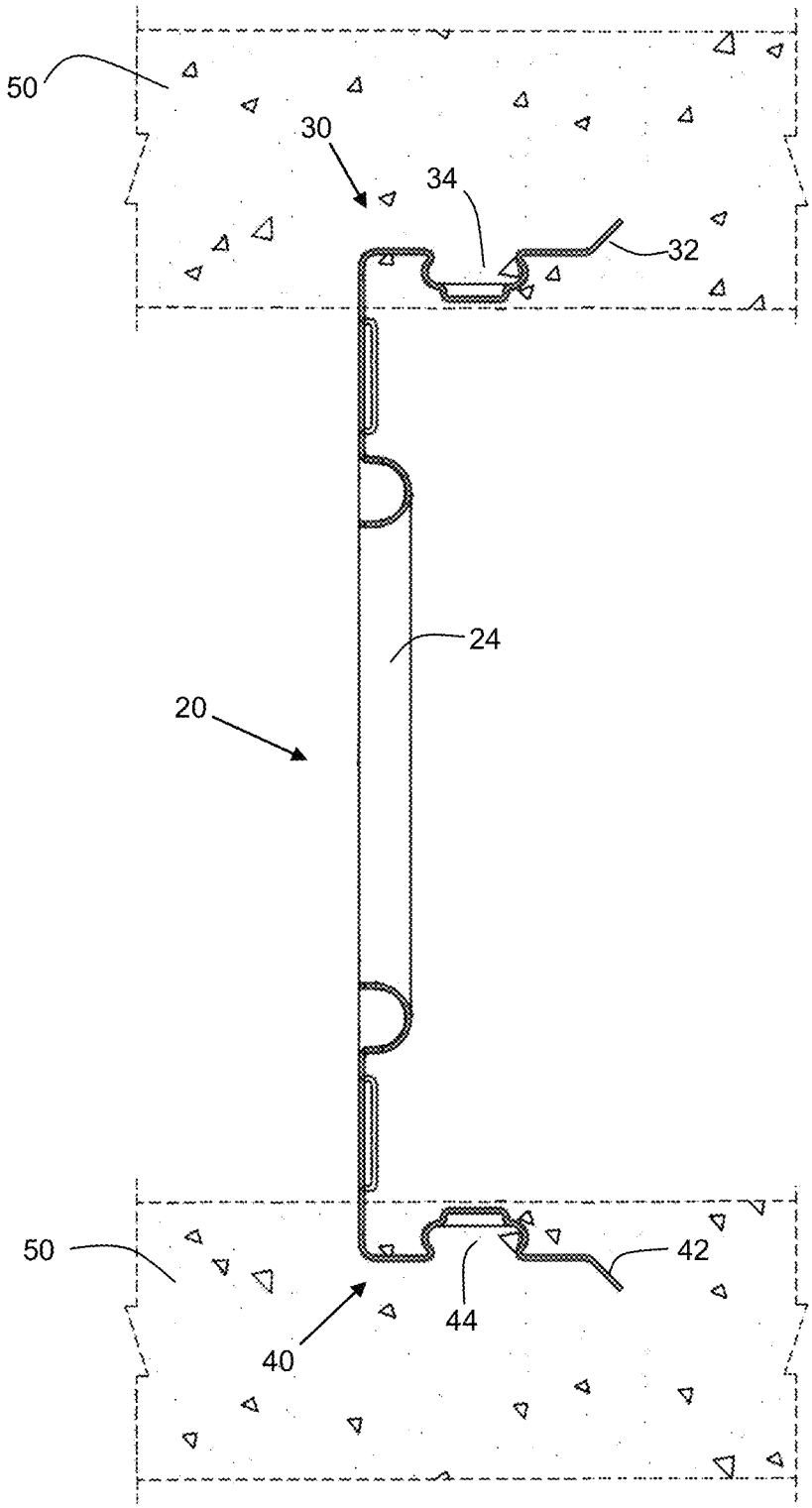
FIG. 27 is a cross-sectional view of an alternative embodiment of the present cold formed metal stud.

Embodiments of the present cold formed stud 10 having at least one closed section flange 200 can have one or more embedment features so as to be used in applications for embedment in a hardenable fluid, including but not limited to concrete. For example, closed section flange 200 can be attached to protruding studs 230 spaced along the length of upper closed section flange 200, by welding or other suitable methods known in the art. Protruding studs 230 can be embedded in a concrete panel 50, as seen in FIG. 26A. In at least one alternative embodiment, closed section flange 200 can have indentations 210 on its outward faces, as seen in FIG. 26B. Concrete can flow into indentations 210, so as to tie cold formed stud 10 to concrete panel 50 and to prevent delamination of the concrete from closed section flange 200 under application of a load.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

The invention claimed is:

1. A cold formed metal stud, the stud comprising:

a vertically extending web, said web having a first longitudinal edge and a second longitudinal edge;

a first flange portion for embedment in a hardenable fluid, the first flange portion vertically extending along said first longitudinal edge, said first flange portion having a first end flange and a vertically extending first channel adapted to receive the hardenable fluid, said first channel having walls shaped to include bulges, such that the first channel has a dovetail shaped cross-sectional profile, said first end flange forming an obtuse angle with said first flange portion for embedment in the hardenable fluid; and a second flange portion vertically extending along said second longitudinal edge;

wherein the stud provides support for a wall structure.

2. The cold formed metal stud of claim 1, said first channel having at least one channel perforation.

3. The cold formed metal stud of claim 1, said first channel having at least one channel indentation.

4. The cold formed metal stud of claim 1, wherein said second flange portion comprises a second end flange and a vertically extending second channel adapted to receive a hardenable fluid, said second end flange forming an obtuse angle with said second flange for embedment in the hardenable fluid.

5. The cold formed metal stud of claim 1, wherein said second flange portion is a closed section flange.

6. The cold formed metal stud of claim 1, said web further comprising at least one web opening located along the centerline of said web.

7. The cold formed metal stud of claim 6, said at least one web opening having a stiffening rim extending around the perimeter thereof.

8. The cold formed metal stud of claim 1, said web further comprising one or more stiffening elements each independently selected from a longitudinally extending stiffening rib, a stiffening indentation and a transverse stiffening rib.

9. A double stud comprising a first cold formed metal stud according to claim 1 and a second cold formed metal stud according to claim 1, wherein the vertically extending web of said first cold formed stud abuts the vertically extending web of said second cold formed stud.

10. A method of forming a composite panel assembly comprising a cold formed metal stud according to claim 1, the method comprising the steps of:

pouring a concrete panel; and, embedding the first flange portion of the cold formed metal stud in said concrete panel, said first flange portion located along a first longitudinal edge of a vertically extending web of said cold formed metal stud;

wherein when said concrete panel solidifies, said cold formed metal stud and said concrete panel form a composite panel assembly.

11. A method of manufacturing a cold formed metal stud according to claim 1, the method comprising the steps of:

forming a first flange portion along a first longitudinal edge of a vertically extending web, said first flange portion for embedment in a hardenable fluid;

forming a vertically extending first channel along said first flange portion, said first channel adapted to receive the hardenable fluid;

forming a first end flange along said first flange portion, said first end flange forming an obtuse angle with said first flange for embedment in the hardenable fluid; and forming a second flange portion along a second longitudinal edge of said vertically extending web;

wherein the stud provides support for a wall structure.

* * * * *